US009872575B2

(12) United States Patent
Mikesell

(10) Patent No.: US 9,872,575 B2
(45) **Date of Patent: *Jan. 23, 2018**

(54) BED COVERING

(71) Applicant: Elizabeth Mikesell, Riverton, UT (US)

(72) Inventor: Elizabeth Mikesell, Riverton, UT (US)

(73) Assignee: BAE, LLC, South Jordan, UT (US)

( * ) Notice: Subject to any disclaimer, the term of this patent is extended or adjusted under 35 U.S.C. 154(b) by 199 days.

This patent is subject to a terminal disclaimer.

(21) Appl. No.: 14/840,278

(22) Filed: Aug. 31, 2015

(65) Prior Publication Data

US 2015/0366380 A1 Dec. 24, 2015

Related U.S. Application Data

(63) Continuation of application No. 14/166,607, filed on Jan. 28, 2014, now Pat. No. 9,149,136.

(60) Provisional application No. 61/757,614, filed on Jan. 28, 2013.

(51) Int. Cl.

| | |
|---|---|
| ***A47G 9/02*** | (2006.01) |
| ***A47C 21/02*** | (2006.01) |
| ***A47G 9/04*** | (2006.01) |

(52) U.S. Cl.

CPC ..... *A47G 9/0246* (2013.01); *A47C 21/022* (2013.01); *A47G 9/02* (2013.01); *A47G 9/0223* (2013.01); *A47G 9/04* (2013.01); *A47C 21/028* (2013.01); *A47G 9/0238* (2013.01)

(58) Field of Classification Search

CPC ..... A47G 9/02; A47G 9/04; A47G 9/0223; A47G 9/0238; A47G 9/0246; A47G 9/10; A47C 21/022; A47C 21/028; A47C 31/105

See application file for complete search history.

(56) References Cited

U.S. PATENT DOCUMENTS

| | | | |
|---|---|---|---|
| 1,644,852 | A | 10/1927 | Ness |
| 1,972,919 | A | 9/1934 | Chambless |
| 2,139,980 | A | 12/1938 | Morris |
| 3,530,487 | A | 9/1970 | Beer |
| 3,857,124 | A | 12/1974 | Hadley |
| 4,161,044 | A | 7/1979 | Bogle |
| 4,241,466 | A | 12/1980 | Mendyk |
| 4,266,308 | A | 5/1981 | Shatz |

(Continued)

FOREIGN PATENT DOCUMENTS

AU 2013100545 B4 4/2013

OTHER PUBLICATIONS

U.S. Appl. No. 29/480,679, Jan. 29, 2016, Notice of Allowance.

(Continued)

*Primary Examiner* — Nicholas F Polito
*Assistant Examiner* — David R Hare
(74) *Attorney, Agent, or Firm* — Keller Jolley Preece

(57) ABSTRACT

The present disclosure is directed to a bed covering. In some embodiments, a bed covering according to the present disclosure can include a fitted base configured to at least partially enclose a mattress, a comforter portion including an end connected to the fitted base and sides removably connectable to sides of the fitted base, and extendable side flaps connected to the sides of the comforter portion. Additional and alternative embodiments of the bed covering are disclosed herein and/or will be evident from the principles described herein.

20 Claims, 8 Drawing Sheets

(56) References Cited

U.S. PATENT DOCUMENTS

| | | | | |
|---|---|---|---|---|
| 4,292,700 | A | 10/1981 | Markel | |
| 4,304,018 | A | 12/1981 | McClam | |
| D267,696 | S | 1/1983 | Adams | |
| 4,658,454 | A | 4/1987 | Potter | |
| 4,924,543 | A | 5/1990 | Hoss et al. | |
| 5,020,177 | A | 6/1991 | Etherington | |
| D323,442 | S | 1/1992 | Trader | |
| 5,084,929 | A | 2/1992 | Staudinger | |
| 5,118,553 | A * | 6/1992 | Boisson | A47G 9/0238 24/381 |
| D348,348 | S | 7/1994 | Lawson | |
| 5,566,411 | A * | 10/1996 | Eiler | A47G 9/02 5/484 |
| D376,720 | S | 12/1996 | Thode et al. | |
| 5,666,680 | A | 9/1997 | Hackett, Jr. | |
| D385,144 | S | 10/1997 | Kozole et al. | |
| 6,044,503 | A | 4/2000 | McClendon | |
| 6,098,219 | A * | 8/2000 | Milber | A47C 21/022 5/494 |
| 6,108,836 | A | 8/2000 | Keene, III | |
| D433,865 | S | 11/2000 | Willbanks | |
| 6,286,162 | B1 | 9/2001 | Huart | |
| 6,490,741 | B1 | 12/2002 | Wheeler | |
| D477,959 | S | 8/2003 | Shunk | |
| 7,047,580 | B2 | 5/2006 | Finn | |
| 7,086,102 | B1 * | 8/2006 | Frazier | A47G 9/02 5/494 |
| 7,260,858 | B2 * | 8/2007 | Cushing | A47G 9/0246 5/494 |
| 7,487,560 | B2 | 2/2009 | McGrath et al. | |
| 7,487,561 | B2 | 2/2009 | Ho | |
| D593,788 | S | 6/2009 | Thompson | |
| D598,231 | S | 8/2009 | Thompson | |
| D641,556 | S | 7/2011 | Hutchison | |
| 8,122,541 | B1 * | 2/2012 | Georgatos | A47G 9/0238 5/494 |
| 8,151,386 | B2 | 4/2012 | McKee | |
| 8,214,949 | B2 | 7/2012 | Thompson | |
| D677,961 | S | 3/2013 | McKee | |
| 8,656,535 | B1 * | 2/2014 | Adorney | A47G 9/0238 5/495 |
| 8,756,730 | B2 | 6/2014 | MacDonald | |
| D713,655 | S | 9/2014 | Blatt et al. | |
| 8,898,835 | B2 | 12/2014 | Khan | |
| 8,950,024 | B1 * | 2/2015 | Hudson | A47G 9/02 5/485 |
| 9,095,230 | B2 * | 8/2015 | Shattuck | A47G 9/0223 |
| 9,149,136 | B2 * | 10/2015 | Mikesell | A47G 9/02 |
| 2001/0032358 | A1 | 10/2001 | Talley-Williams | |
| 2004/0200000 | A1 | 10/2004 | Harbin et al. | |
| 2006/0168726 | A1 | 8/2006 | Cushing | |
| 2007/0000053 | A1 | 1/2007 | Yang | |
| 2007/0101496 | A1 | 5/2007 | Ho | |
| 2007/0214569 | A1 | 9/2007 | Miller | |
| 2009/0044337 | A1 * | 2/2009 | McKee | A47G 9/02 5/496 |
| 2010/0064435 | A1 | 3/2010 | Stuart | |
| 2010/0107336 | A1 * | 5/2010 | Ross | A47G 9/02 5/490 |
| 2010/0154119 | A1 | 6/2010 | Shuttleworth | |
| 2010/0154122 | A1 * | 6/2010 | Crispino | A47C 21/028 5/636 |
| 2010/0251482 | A1 * | 10/2010 | MacDonald | A47G 9/02 5/494 |
| 2010/0306920 | A1 | 12/2010 | Balasundharam | |
| 2012/0167306 | A1 | 7/2012 | MacDonald | |
| 2013/0198956 | A1 | 8/2013 | Khan | |
| 2013/0269107 | A1 * | 10/2013 | Fiene | A47G 9/02 5/485 |
| 2013/0278431 | A1 * | 10/2013 | Shilts | A47G 9/02 340/686.6 |
| 2014/0101850 | A1 | 4/2014 | Cuneo | |
| 2015/0033475 | A1 | 2/2015 | Khan | |

OTHER PUBLICATIONS

U.S. Appl. No. 14/166,607, Mar. 21, 2014, Office Action.
U.S. Appl. No. 14/166,607, Dec. 1, 2014, Office Action.
U.S. Appl. No. 14/166,607, Apr. 3, 2015, Office Action.
U.S. Appl. No. 14/166,607, Jun. 25, 2015, Notice of Allowance.
U.S. Appl. No. 29/480,679, filed Jan. 28, 2014, Mikesell.
U.S. Appl. No. 29/480,679, Apr. 27, 2015, Office Action.
U.S. Appl. No. 29/480,679, Nov. 6, 2015, Notice of Allowance.

* cited by examiner

BED COVERING

CROSS-REFERENCE TO RELATED APPLICATIONS

The present application is a continuation of U.S. application Ser. No. 14/166,607, filed Jan. 28, 2014, which claims the benefit of and priority to U.S. Provisional Application No. 61/757,614, filed Jan. 28, 2013. Each of the aforementioned application(s) are hereby incorporated by reference in their entirety.

BACKGROUND OF THE INVENTION

1. The Field of the Invention

This application relates generally to bed coverings. More particularly, this application relates to bed coverings that are easy and fast to make up.

2. Background and Relevant Art

Conventional bed sheets are available in two basic varieties. First, a fitted bottom sheet covers the mattress, and a flat top sheet goes over the top of the fitted bottom sheet. The sheets are usually covered with perhaps a blanket, and then a comforter is the top layer to all the bed coverings. The combination of sheets, blankets, quilts, comforters, bedspreads, or duvets are draped over the mattress, and then tucked in along the sides of the mattress in order to create a neat and tidy appearance to the bed. This process is generally referred to as "making the bed." These various bed coverings are manufactured in a multitude of sizes to accommodate the various mattress sizes (such as twin, full, queen, king, etc.), mattress depths (including standard and pillow top), and various mattress types (i.e., those used in beds at home or those used in hotels, hospitals, barracks, campers, recreational vehicles, sofa beds, cribs, etc.). Additionally, bed coverings are generally manufactured in a wide range of fabrics, colors, and patterns, in order to add a decorative aesthetic to the room in which the bed is placed.

The changing of bed coverings and "making the bed is often regarded as a chore. A great deal of time is expended to remake the entire bed due to the loosening of the top sheet, and other blankets or bedspreads. For when the top sheet is kicked free, so are the sheets and covers above. Sometimes, even the fitted sheet on top of the mattress is loosened during a night of sleep. Depending upon the number of sheets or covers on top of the sheets, and the size and type of mattress, it can take a long time to make the bed. In settings other than the home, such as a hotel, the collective time to make such beds, or change such beds can be significant. Further, the difficulties of making a bed can be compounded in settings where space is limited (e.g., in a camper trailer) or for some unique bed configurations (e.g., for a trundle bed or bunk beds).

Accordingly, a need exists for bed coverings that make it easy to make a bed with. Also, a need exists for bed coverings that look and feel comfortable and stylish while still being easy to keep made up and tidy.

BRIEF SUMMARY OF THE INVENTION

The present invention is directed to a bed covering. In some embodiments, the bed covering can include a fitted base configured to at least partially enclose a mattress; a comforter portion including an end connected to the fitted base and sides removably connectable to sides of the fitted base; and extendable side flaps connected to the sides of the comforter portion. In an exemplary embodiment, the sides of the comforter portion are removably attachable to sides of the fitted base via zippers that run down the long sides of the comforter portion and the fitted base.

Additional features and advantages of the present invention will be set forth in the description that follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof that are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings.

DETAILED DESCRIPTION

Embodiments of the present invention provide benefits and/or solve one or more of the foregoing or other problems in the art for providing bed coverings that feel like traditional bedding while being slept in, and are easy to keep neat and tidy when not being slept in. Changing bed coverings, or tucking in blankets and sheets after sleeping in them all night are processes that can be cumbersome and difficult, especially for children. Both processes are further compounded in difficulty when the bed being made is nonstandard, such as a bunk bed, a crib, a murphy bed, a hospital bed with rails, a military barracks bed, etc.

Figure 1:
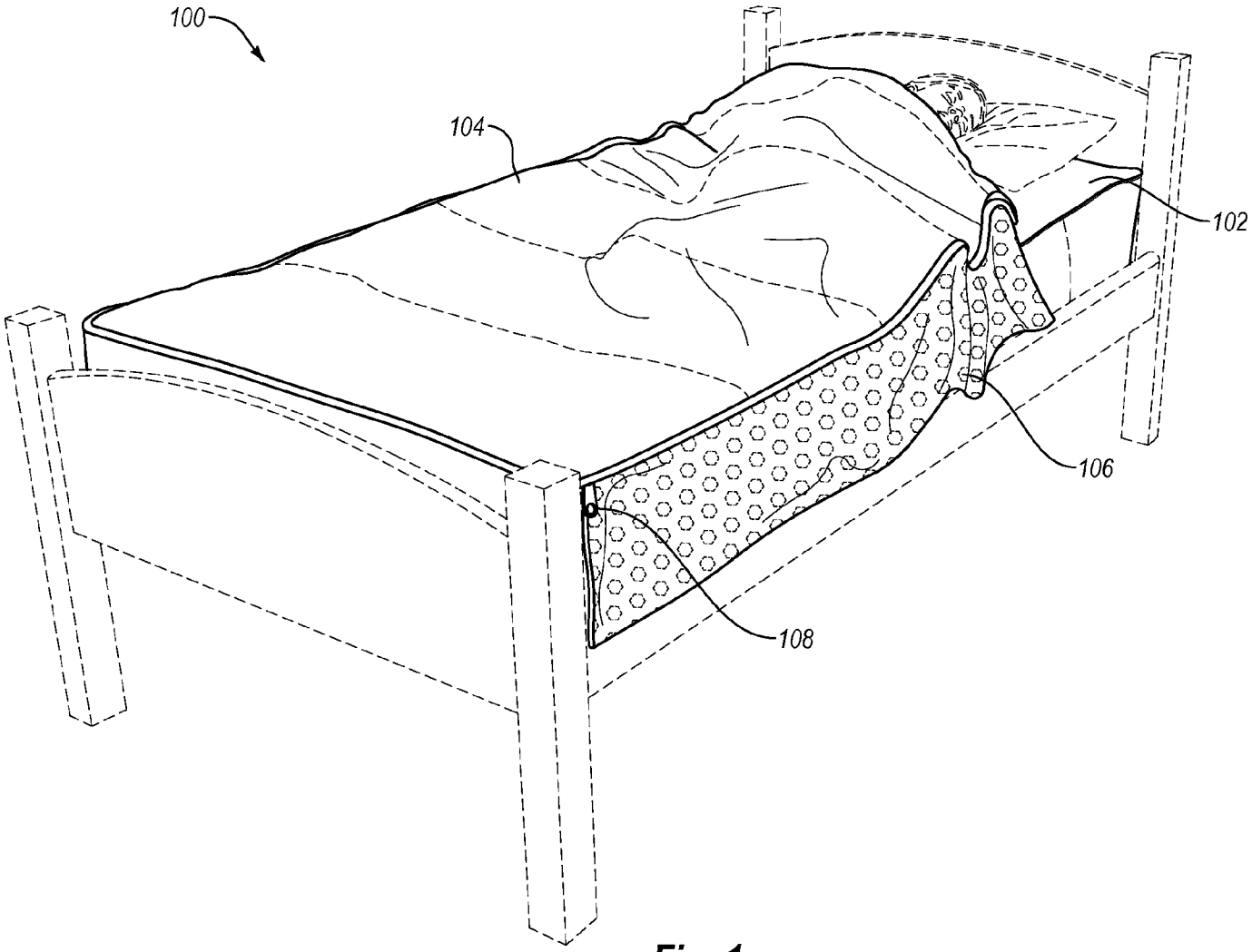
FIG. 1 illustrates a perspective view of an example bed covering according to the principles described herein, wherein the bed covering is in use.

The bed coverings disclosed in the present application overcome one or more of the foregoing disadvantages and provide a number of advantages over traditional bed coverings. For example, the bed coverings disclosed herein are easy to put on a bed initially and make it easy to make the bed after being slept in. Additionally, bed coverings according to the present application feel like traditional bed coverings and provide the same comfort and warmth that a user would expect from those kinds of traditional coverings. Further, the bed coverings described herein allow a user to make the bed without the need for "tucking" the sides of the bed covering along or under the sides of the mattress, but still appears tucked in when made. These and other advantages will become evident from the FIG. 1 shows an example embodiment of a bed covering 100 according to the present invention. In particular, FIG. 1 shows the bed covering 100 in use by a child on a twin-sized bed. The bed covering 100 can include a fitted base 102 configured to at least partially enclose a mattress, a comforter portion 104 configured to cover a person using the bed covering 100, side flaps 106 extending from the sides of the comforter portion 104, and one or more zipper pulls 108 corresponding to a one or more zippers (not shown) extending along the sides of the fitted base 102 and the comforter portion 104 and used to open and close the bed covering 100.

When the side of the bed covering 100 is opened (e.g., unzipped), the bed covering 100 feels like traditional bed coverings to a sleeping user. For example, with the bed covering 100 open, the side flap(s) 106 can extend out the side of the bed covering 100 and hang down the side(s) of the mattress. As such, the comforter portion 104 and the side flap(s) 106 can feel to the sleeping user like traditional blankets that are un-tucked for sleeping; retaining warmth and keeping the user effectively covered, even if the user moves around while sleeping. Additionally or alternatively, the user can tuck the side flap 106 under their person without the zipper along the side of the comforter portion 104 coming into direct contact with the person's skin, thereby preventing any potential discomfort associated with the zipper. Although FIG. 1 only shows one side of the bed covering 100, one will appreciate that both sides of the bed covering 100 can include a side flap 106.

Although the illustrated bed covering 100 is made for use with a twin-sized bed, in further embodiments, the bed covering 100 can be made for use with any other size of mattress (e.g., a crib size mattress, a full size mattress, a queen size mattress, a king size mattress, or any other size of mattress or bed). Furthermore, it will be understood that while a zipper is illustrated in the embodiments described herein, any structure for removably attaching the comforter portion 104 to the fitted base 102 can be used. For example, hook and loop closures, buttons, snaps, fabric ties, or any other suitable connector(s) can be used for the same purpose.

The fitted base 102 can be sized and shaped to at least partially enclose a mattress. For example, the fitted base 102 can be sized to fit the top of the mattress and extend down around the sides of the mattress. The comforter portion 104 can be approximately the same size as the top of the fitted base 102 as well as the top of the mattress. The side flap 106 extends from the side of the comforter portion 104 and hangs down over the side of the bed. The side flap 106 may hang down to a length that is approximately as deep as the mattress. In another embodiment, the side flap 106 may hang down to a lesser or greater length. The side flaps 106 can be as long as the sides of the comforter portion 104. The zippers (or other connectors) can also run the lengths of the sides of the fitted base 102 and the comforter portion 104 and allows the two to be removably connected.

Figure 2:
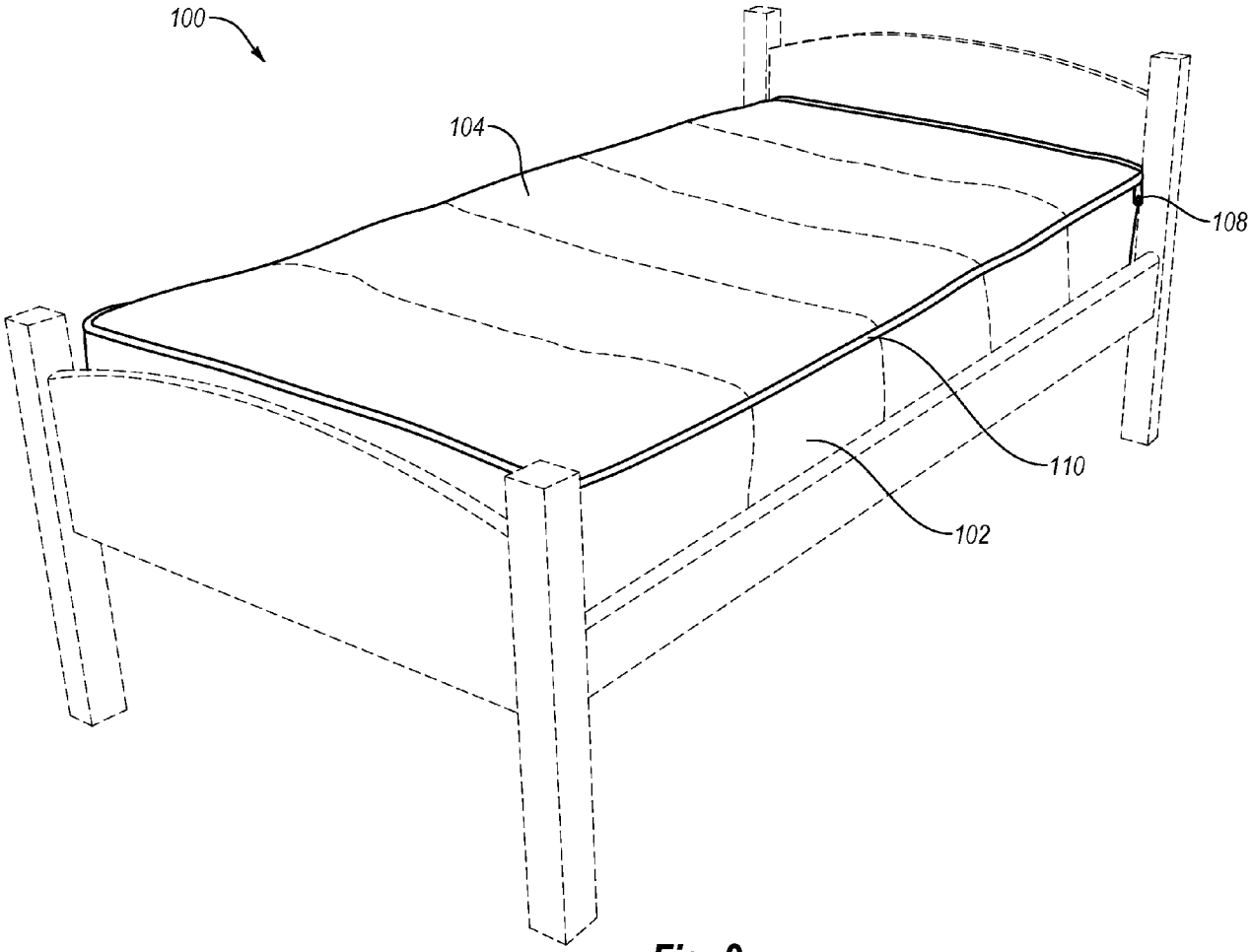
FIG. 2 illustrates another perspective view of the bed covering of FIG. 1 being made up on a bed.

FIG. 2 shows the bed covering 100 after the bed covering 100 has been "made up." In other words, the bed covering 100 has been arranged to appear neat and tidy after having been slept in. This can be easily accomplished by tucking the side flaps 106 (not shown in FIG. 2) under the comforter portion 104 and then zipping up the bed covering 100 using the zipper pulls 108, as evidenced by the zipper pull 108 at the top corner of the comforter portion 104 and the fitted base 102. As further shown in FIG. 2, the bed covering 100 can include a zipper flap 110. The zipper flap 110 follows along the edges of the comforter portion 104 and serves to hide the zipper when the sides of the bed covering 100 are zipped up. In hiding the zipper, the zipper flap 110 can make the bed covering 100 appear more like traditional bed coverings.

In some examples, and as further shown in FIG. 2, the fitted base 102 can include extend down and around the enclosed mattress. In some examples, the fitted base 102 can include a series of gusseted panels that serve to create a tight fit between the fitted base 102 and the enclosed mattress. The fitted base 102 can be made of the same material as the comforter portion 104, making the comforter portion 104 and fitted base 102 appear to be one continuous blanket extending over and down the sides of the bed covering 100.

In making the bed covering 100, it is unnecessary to tuck any portion of the bed covering 100 down the sides of the mattress (e.g., between the mattress and a wall or between the mattress and a bed rail) and/or under the mattress. In other words, the bed covering 100 does not include any overhanging sheets or blankets that hang over the side of the mattress and that must be tucked under the mattress to "make the bed." This is particularly beneficial when the bed covering 100 is used in conjunction with beds that have railings, such as bunk beds or hospital beds. This feature of the bed covering 100 is also advantageous when the bed covering 100 is used on a mattress up against a wall or on mattresses that are otherwise in close quarters, such as campers, RVs, boats, or military barracks.

In some embodiments, the bed covering 100 can be constructed and/or designed to give the appearance of a single comforter covering, extending around, and tucked under the sides of the mattress. For example, the material and/or design used on the top of the comforter portion 104 can match the material and/or design used along the sides of the fitted base 102. Accordingly, the bed covering 100 appears to be a single comforter draped over and tucked under the sides of the mattress. As such, the bed covering 100 appears more like traditional bed coverings that have been made up.

The fitted base 102, the comforter portion 104, and side flaps 106 of the bed covering 100 may each be constructed out of a variety of materials, such one or more fabrics. For example, the fitted base 102, comforter portion 104, and the side flaps 106 may each be constructed of different materials for the purpose of making the bed covering 100 softer, warmer, cooler, more uniform, more colorful, etc. In this way, the bed covering 100 may be manufactured for a variety of uses and climates. In some embodiments, any part of the bed covering 100 may be manufactured out of waterproof material, making the bed covering 100 appropriate for kid's mattresses, hospital beds, or elder care facility beds.

In yet further embodiments, different materials can be used for different portions of the bed covering 100. To illustrate, the upper surface of the comforter portion 104 may be a patterned fabric (e.g., a patterned cotton or any other suitable patterned material) to provide a decorative visible design while the underside of the comforter portion 104 may be a soft fabric (e.g., a jersey-knit fabric, a minky fabric, or any other suitable soft fabric) to provide a soft and comfortable surface for the user. Additionally or alternatively, the sides of the fitted base 102 can be made of the same fabric as the upper surface of the comforter portion 104 to match a pattern or design of the comforter portion 104, while the upper surface of the fitted base 102 can be made of the same fabric as the underside of the comforter portion 104 to provide a soft surface upon which the user lays. In an additional or alternative embodiment, the underside of the comforter portion 104 and the upper surface of the fitted base 102 can be made using different materials and/or materials similar to traditional bed sheets. Other fabrics that can be used and/or combined to make the different sections of the bed covering 100 can include but are not limited to: wool, cotton, Egyptian cotton, pima cotton, upland cotton, Supima®, MicroCotton®, Tencel®, silk, polyester, or any other fabric type that is suitable for bedding.

Figure 3:
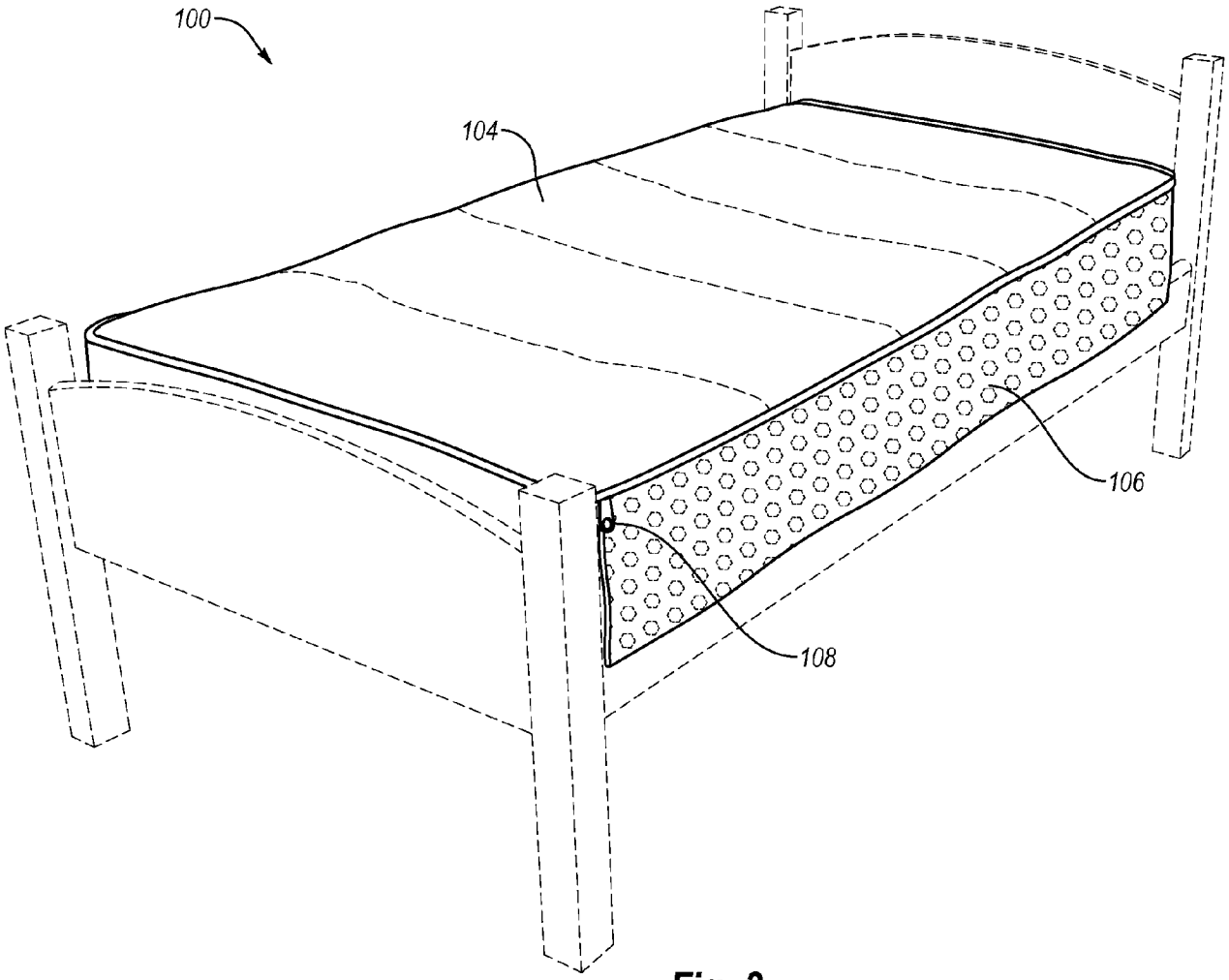
FIG. 3 illustrates yet another perspective view of the bed covering of FIG. 1 with a side flap extended.

FIG. 3 shows the bed covering 100 opened (e.g., unzipped). As shown, the zipper pull 108 has been pulled all the way to the bottom corner of the mattress. With the bed covering 100 opened, the side flap 106 can extend out from the comforter portion 104 and hang down the sides of the mattress.

The side flap 106 can be constructed of the same material as the comforter portion 104, or it can be made of different material. Additionally or alternatively, the side flap 106 can be constructed so as to have one type of material on the outer surface and another type of material on the inner surface. In this way, the comforter portion 104 and the side flap 106 may be decorative or utilitarian on their outer-faces, while having inner-faces that are soft, warm, and comfortable to sleep in. In some embodiments, the outer surfaces of the comforter portion 104 and the side flap 106 can be manufactured of the same materials or having the same design so as to give the appearance that the side flaps 106 are an extension of the comforter portion 104, or that the comforter portion 104 and the side flaps 106 together form a single blanket covering and extending down the sides of the mattress.

Furthermore, as shown in FIG. 3, extending the side flaps 106 effectively locks the zipper pull 108 in place, thereby preventing the bed covering 100 from being zipped closed until the side flap 106 is tucked back under the comforter portion 104. Once the side flap 106 is folded back under the comforter portion 104, the zipper pull 108 becomes free to slide along the side of the bed covering in order to zip up the bed covering 100.

Figure 4:
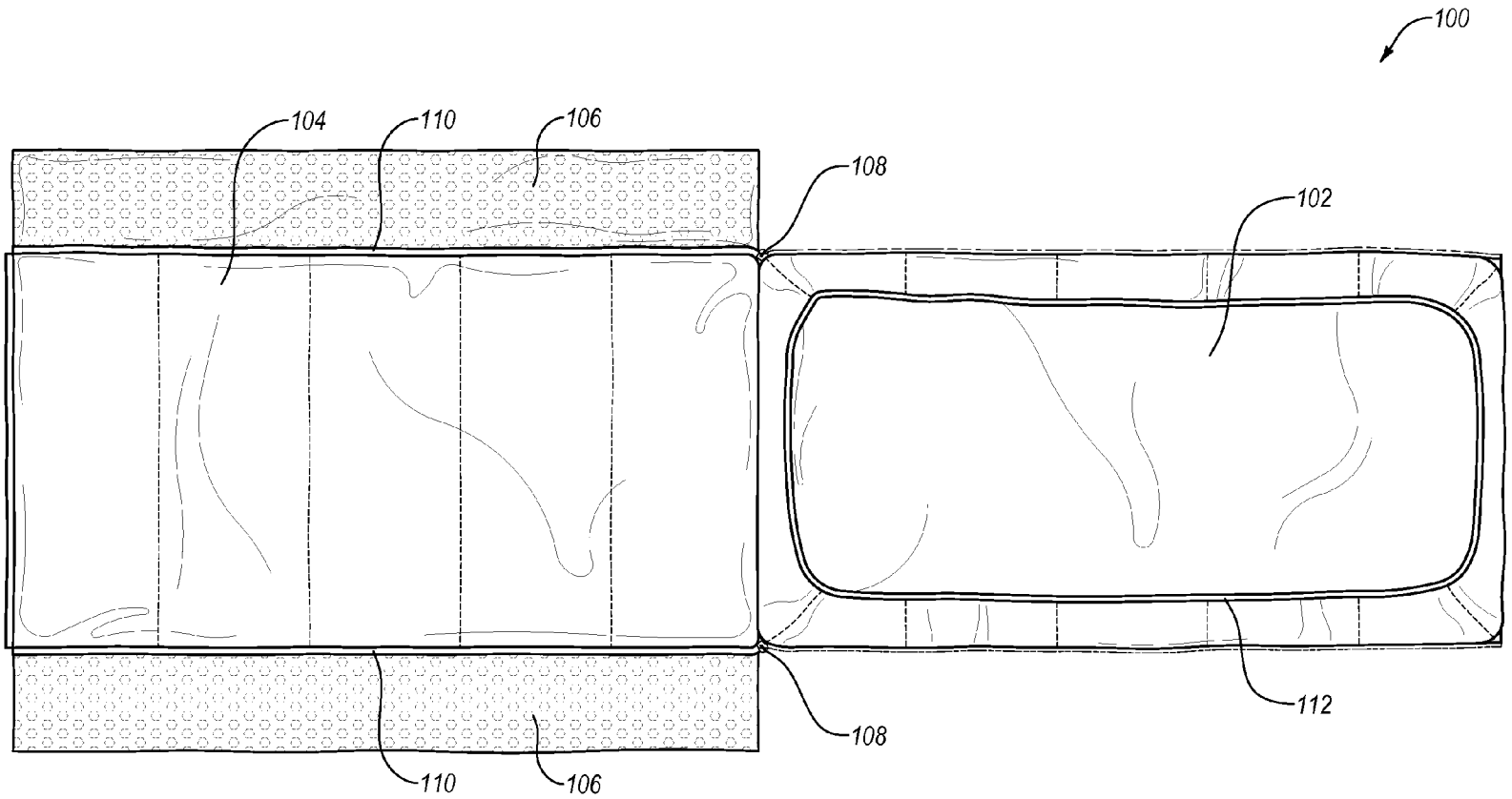
FIG. 4 illustrates a bottom view of the bed covering of FIG. 1, wherein the bed covering is opened.

FIG. 4 illustrates the bed covering 100 opened and laid out, such that the bottom of the fitted base 102 is shown along with the side flaps 106 and the top of the comforter portion 104. In this configuration it can be seen that the fitted base 102 includes a series of gusseted panels and an elastic edge 112 that create a pocket to receive a mattress. When a user is initially making a mattress up with the bed covering 100, the user must simply stretch the fitted base 102 and the elastic edge 112 over and around the sides of the mattress. The elastic edge 112 pulls the fitted base 102 around the mattress, thereby creating a tight fit between the fitted base 102 and the mattress. In addition, the sides of the fitted base 102 can be further made out of material that is elastic.

As already mentioned above, FIG. 4 also shows that the comforter portion 104 includes the side flaps 106 along both sides of the bed covering 100. Accordingly, the sleeper can get into or out of the bed covering 100 on either side of the mattress. Also shown in FIG. 4 are the zipper pulls 108 and zipper flaps 110. The zipper flaps 110 hide the zippers along sides of the comforter portion 104 when the bed covering 100 is closed, and may also be decorative, such as when placed along the top of the comforter portion 104. It should be noted that while the comforter portion 104 and side flaps 106 are shown in FIG. 4 as being made of different materials, in another embodiment, the comforter portion 104 and side flaps 106 may be made of the same material.

Also shown in FIG. 4 in detail, a foot of the comforter portion 104 can be connected (e.g., sewn) to a foot of the fitted base 102. When the bed covering 100 is unzipped, the comforter portion 104 can open away from the fitted base 102. In another embodiment, the comforter portion 104 can be removably connected (e.g., zipped) to the fitted base 102. In that configuration, the comforter portion 104 and fitted base 102 would be completely separable. That could be advantageous in situations where only one portion of the bed covering 100 needed to be changed and washed, such as after a bed-wetting incident. Although not shown in FIG. 4, a zipper that connects any side of the comforter portion 104 to its corresponding side of the fitted base 102 is arranged such that one-half of the zipper teeth are situated along a side of the comforter portion 104 with the other one-half of the zipper teeth situated along the corresponding side of the fitted base. The same is true in other embodiments that utilize different connectors for removably connecting the comforter portion 104 to the fitted base 102, such as buttons and button holes, hooks and loops, male and female snaps, fabric ties, etc.

Figure 5:
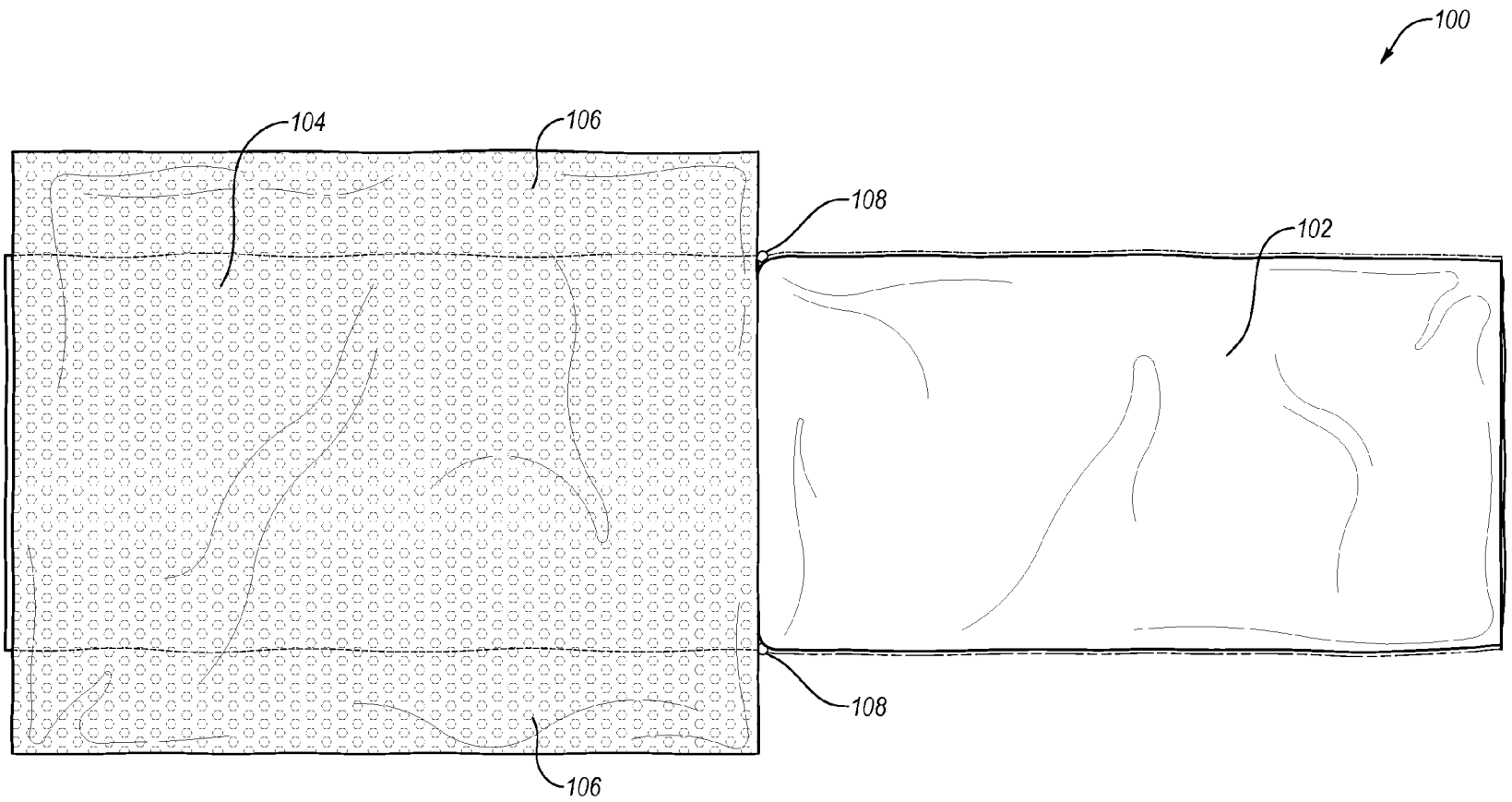
FIG. 5 illustrates a top view of the bed covering of FIG. 1, wherein the bed covering is opened.

FIG. 5 illustrates another view of the bed covering 100 opened up, showing the top of the fitted base 102 and the underside of the comforter portion 104 with the side flaps 106 extended. As shown, the side flaps 106 can be connected (e.g., sewn) to the comforter portion 104 along one or more side seams of the comforter portion 104. The same seams can also serve to indicate where the zipper (not shown) and zipper flap 110 are located on the top of the comforter portion 104, as shown in FIG. 4. In particular, the seams can represent where the zipper and zipper flap 110 are sewn to the comforter portion 104 and/or side flaps 106.

Although the side flaps 106 are described separately from the comforter portion 104, it should be understood that the side flaps 106 can be a part of or integral to the comforter portion 104. For example, as shown in FIG. 5, the underside of the comforter portion 104 and the underside of the side flaps 106 can be made of a single piece of fabric. Accordingly, the side flaps 106 allow the comforter portion 104 to expand beyond and over the sides of the mattress when the bed covering 100 is opened. In another embodiment, the comforter portion 104 and the side flaps 106 may be constructed of different pieces and/or types of fabric connected together.

Figure 7:
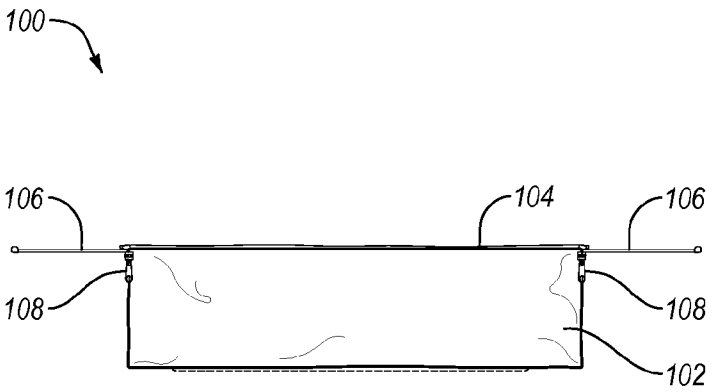
FIG. 7 illustrates a view of a second end of the bed covering of FIG. 1.
Figure 6:
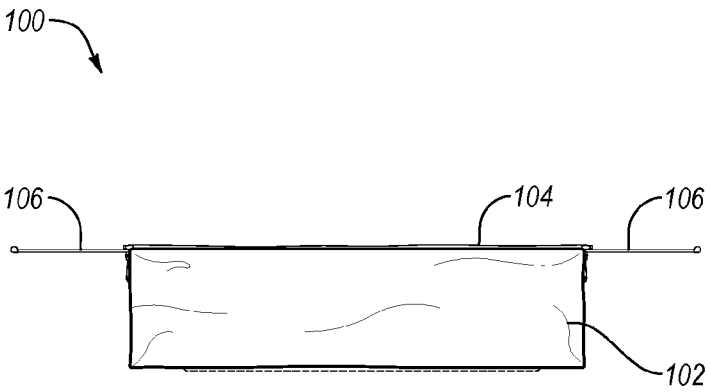
FIG. 6 illustrates a view of a first end the bed covering of FIG. 1.

FIGS. 6 and 7 illustrate views of opposite ends of the bed covering 100. In particular, FIG. 6 shows a view taken from the head of the bed covering 100, while FIG. 7 shows a view taken from the foot of the bed covering 100. FIGS. 6 and 7 illustrate how the fitted base 102 can extend around the ends of a mattress.

Figure 8:
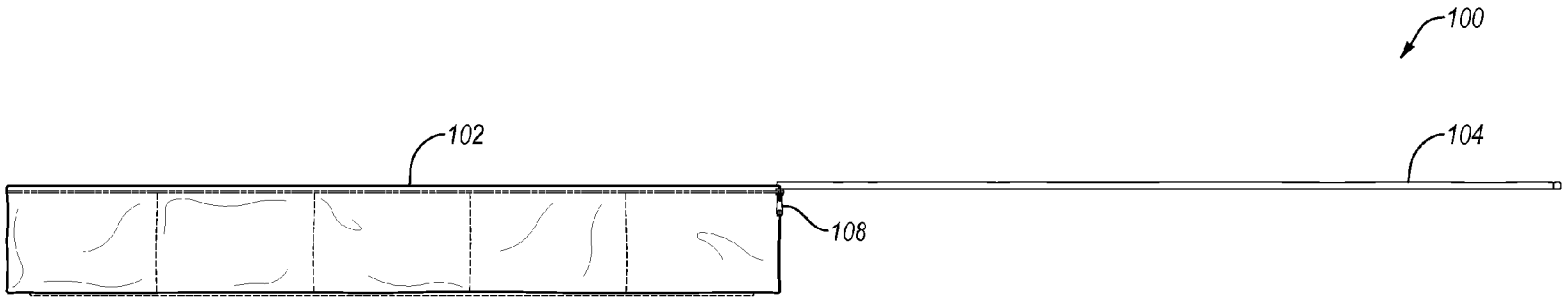
FIG. 8 illustrates a view of a first side of the bed covering of FIG. 1.
Figure 9:
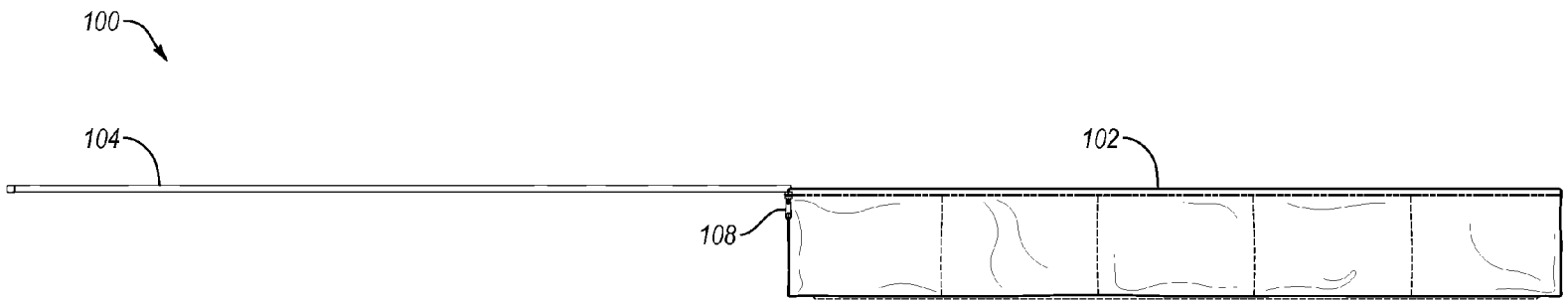
FIG. 9 illustrates a view of a second side of the bed covering of FIG. 1.

FIGS. 8 and 9 also illustrate views of opposite sides of the bed covering 100 in an opened (unzipped) position. FIG. 8 shows a view taken from a first side of the bed covering 100, while FIG. 9 shows a view taken from the opposite side of the bed covering 100. Again, FIGS. 8 and 9 illustrate how the fitted base 102 can extend over and around the sides of a mattress. Also shown are the zipper pulls 108 adjacent to the foot of the fitted base 102. This allows the comforter portion 104 of the bed covering 100 to open away from the fitted base 102 as shown.

Figure 10:
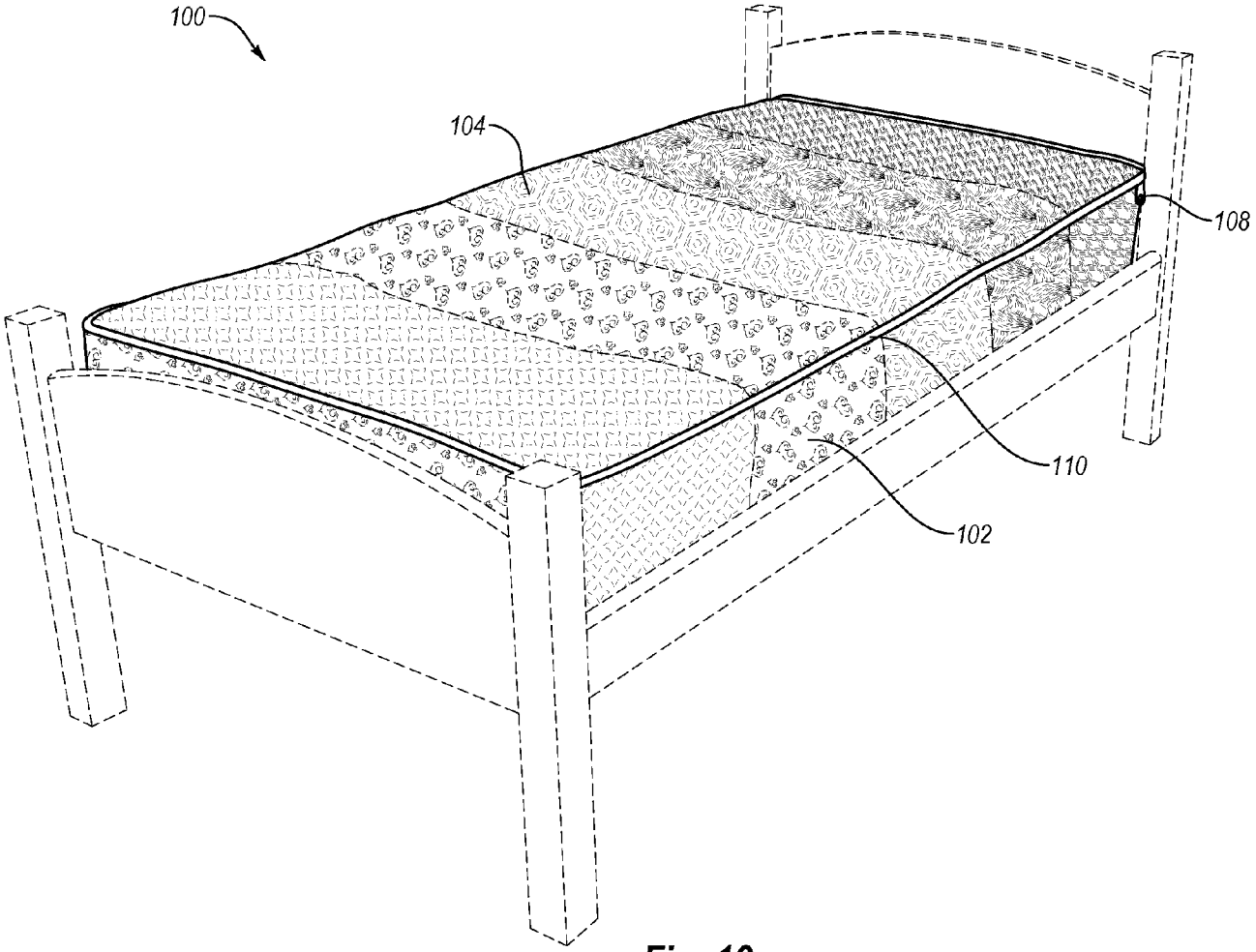
FIG. 10 illustrates a perspective view of a particular implementation of an example bed covering according to principles described herein.

As mentioned above, the bed covering 100 can be configured to give the appearance that bed covering comprises a single comforter that covers the mattress and extends around and is tucked under the sides of the mattress. FIG. 10 illustrates an example embodiment of this feature, in which one or more designs or patterns on the comforter portion 104 can extend down the sides of the fitted base 102 to give the appearance that the comforter portion 104 extends over and down the sides of the mattress and is tucked under the mattress. Accordingly, a user need only zip up the bed covering 100 to make the bed, the bed covering 100 gives the appearance of a covering that has been neatly tucked around and under the mattress.

The bed covering 100 described above serves to provide bedding that is comfortable to sleep in and easy to keep neat and tidy when not being slept in. In the foregoing specification, the invention has been described with reference to specific exemplary embodiments thereof. Various embodiments and aspects of the invention(s) are described with reference to details discussed herein, and the accompanying drawings illustrate the various embodiments. The description above and drawings are illustrative of the invention and are not to be construed as limiting the invention. Numerous specific details are described to provide a thorough understanding of various embodiments of the present invention.

The present invention may be embodied in other specific forms without departing from its spirit or essential characteristics. The described embodiments are to be considered in all respects only as illustrative and not restrictive. For example, the methods described herein may be performed with less or more steps/acts or the steps/acts may be performed in differing orders. Additionally, the steps/acts described herein may be repeated or performed in parallel with one another or in parallel with different instances of the same or similar steps/acts. The scope of the invention is, therefore, indicated by the appended claims rather than by the foregoing description. All changes that come within the meaning and range of equivalency of the claims are to be embraced within their scope.

What is claimed is:

1. A bed covering, comprising:

a fitted base configured to at least partially enclose a mattress;

a comforter portion comprising an end removably connectable to the fitted base and sides that are removably connectable to the fitted base; and extendable side flaps connected to the sides of the comforter portion, wherein each extendable side flap has an edge connected to a side of the comforter portion and a free edge opposite the edge connected to the side of the comforter portion, wherein the bed covering has a made configuration, wherein the comforter portion is connected to the fitted base along the sides and the end of the comforter portion with the extendable side flaps tucked in-between the comforter portion and the fitted base, and an un-made configuration, wherein the comforter portion is disconnected from the fitted base along the sides of the comforter portion with the free edges of the extendable side flaps free to extend outward from the sides of the comforter portion.

2. The bed covering of claim 1, wherein the bed covering further comprises a disconnected configuration, wherein the comforter portion is disconnected from the fitted base along the sides of the comforter portion and the end of the comforter portion.

3. The bed covering of claim 1, wherein the edge of each extendable side flap that is connected to the side of the comforter portion is integral with the side of the comforter portion.

4. The bed covering of claim 1, further comprising one or more connectors for removably connecting the sides and end of the comforter portion to the fitted base.

5. The bed covering of claim 4, wherein the one or more connectors comprise at least one of: one or more zippers, one or more buttons, one or more snaps, one or more hook and loop closures, or one or more fabric ties.

6. The bed covering of claim 3, wherein the free edges of the extendable side flaps can extend outward from the sides of the comforter portion only when the bed covering is in the un-made configuration.

7. The bed covering of claim 4, wherein the one or more connectors are inoperable when the bed covering is in the un-made configuration.

8. The bed covering of claim 4, further comprising one or more connector flaps for hiding the one or more connectors, wherein the one or more connector flaps are positioned opposite the one or more connectors relative to the extendable side flaps.

9. The bed covering of claim 8, wherein the one or more connector flaps are constructed out of the same material as the comforter portion.

10. The bed covering of claim 1, wherein a design of the comforter portion is continued from a design of sides of the fitted base.

11. The bed covering of claim 1, wherein an outer surface of the comforter portion that faces away from the mattress is made of a first material and an inner surface of the comforter portion that faces toward the mattress is made of a second material.

12. The bed covering of claim 1, wherein an upper surface of the fitted base that faces away vertically from the mattress is made of a first material and one or more sides of the fitted base that face away horizontally from the mattress are made of a second material.

13. A bed covering, comprising:

a fitted base with two sides and two ends configured to at least partially cover a mattress; and a comforter portion comprising an end removably connectable to the fitted base and extendable side flaps along two sides of the comforter portion, wherein the comforter portion is removably connectable to the two sides and one end of the fitted base, and wherein each extendable side flap has a free edge along the length of the extendable side flap, wherein the bed covering has a made configuration, wherein the comforter portion is connected to the fitted base along the two sides and one end of the comforter portion with the extendable side flaps tucked in-between the comforter portion and the fitted base, and an un-made configuration, wherein the comforter portion is disconnected from the fitted base along the two sides of the comforter portion with the free edges of the extendable side flaps free to extend outward from the sides of the comforter portion.

14. The bed covering of claim 13, further comprising one or more connectors for connecting the comforter portion to the fitted base.

15. The bed covering of claim 14, further comprising one or more connector flaps for concealing the one or more connectors.

16. The bed covering of claim 15, wherein the extendable side flaps can extend down the sides of a mattress only when the bed covering is in the un-made configuration, and wherein the one or more connectors are inoperable if the extendable side flaps are extended down the sides of a mattress.

17. The bed covering of claim 16, wherein the extendable side flaps provide a barrier between a user and the one or more connectors when the bed covering is in use.

18. The bed covering of claim 17, wherein the extendable side flaps are free to tuck under a person when the bed covering is in the un-made configuration.

19. The bed covering of claim 18, wherein the one or more connectors comprise one or more zipper tracks on the fitted base and one or more zipper tracks on the two sides and one end of the comforter portion.

20. The bed covering of claim 19, wherein when the extendable side flaps are extended outward from the two sides of the comforter portion, the extendable side flaps separate the one or more zipper tracks on the fitted base from one or more zipper tracks on the two sides of the comforter portion.

* * * * *